US007723943B2

(12) United States Patent
Fu et al.

(10) Patent No.: US 7,723,943 B2
(45) Date of Patent: May 25, 2010

(54) RECEIVING METHOD

(75) Inventors: Chung-Yang Fu, Taipei (TW); Wei-Chen Lee, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 295 days.

(21) Appl. No.: 12/061,628

(22) Filed: Apr. 2, 2008

(65) Prior Publication Data

US 2009/0095756 A1 Apr. 16, 2009

(30) Foreign Application Priority Data

Oct. 16, 2007 (TW) ..... 96138646 A

(51) Int. Cl.
*H02P 8/00* (2006.01)

(52) U.S. Cl. ..... 318/696; 318/400.42; 310/49.01; 310/49.55; 49/31; 49/32; 49/373; 49/374; 49/455; 220/503; 220/504; 220/505; 220/528; 312/319.8; 312/321; 312/326; 312/327; 700/231

(58) Field of Classification Search ..... 220/503–505, 220/528; 312/319.8, 321, 326, 327; 700/231; 49/373, 374, 455, 452, 124, 31, 32; 310/49.01, 310/49.55; 318/696, 400.42
See application file for complete search history.

(56) References Cited

U.S. PATENT DOCUMENTS

| | | | | |
|---|---|---|---|---|
| 3,804,223 | A * | 4/1974 | Voegeli | 194/233 |
| 4,202,568 | A * | 5/1980 | Strom | 285/336 |
| 4,544,214 | A * | 10/1985 | Nizel et al. | 312/209 |
| 4,589,712 | A * | 5/1986 | Hastings | 312/236 |
| 4,877,058 | A * | 10/1989 | Stoll | 137/625.48 |
| 5,469,936 | A * | 11/1995 | Lauga et al. | 187/205 |
| 5,803,562 | A * | 9/1998 | Jacobs et al. | 312/283 |
| 6,332,660 | B1 * | 12/2001 | Salice | 312/328 |
| 6,419,482 | B1 * | 7/2002 | Sakata et al. | 432/250 |
| 6,550,602 | B2 * | 4/2003 | Steeber et al. | 198/347.4 |
| 7,004,709 | B2 * | 2/2006 | Frich | 414/362 |
| 7,674,083 | B2 * | 3/2010 | Miyajima et al. | 414/217.1 |
| 2006/0238085 | A1 * | 10/2006 | Greenberg | 312/306 |

* cited by examiner

*Primary Examiner*—Rita Leykin
(74) *Attorney, Agent, or Firm*—Quintero Law Office

(57) ABSTRACT

A receiving method is provided comprising the following steps. First, a receiving device is provided, wherein the receiving device comprises a chamber, a plurality of spacers, a spacer moving module, a first cover unit, a second cover unit, a control unit and an input interface. Then, an order is inputted to the input surface, wherein the input surface sends a control signal according to the order, and the control unit controls movements of the first cover unit, the second cover unit and the spacer moving module according to the control signal.

16 Claims, 19 Drawing Sheets

400

400

100

RECEIVING METHOD

BACKGROUND OF THE INVENTION

1. Field of the Invention

The invention relates to a receiving device, and more particularly to a receiving device which automatically changes receiving space sizes and opening locations.

2. Description of the Related Art

A conventional cabinet comprises a chamber, a plurality of spacers and a door. The spacers define a plurality of receiving spaces in the chamber. The chamber has an opening. The door pivots or slides to open or close the opening, which protects chamber contents.

Conventionally, when the opening is opened, users can access contents stored in all receiving spaces. When a plurality of people share the cabinet, any user can access content belonging to others. Therefore, conventional cabinets cannot provide sufficient confidentiality.

As well, in conventional receiving devices, for example, office cabinets or bookcases, have receiving spaces with fixed sizes. Therefore, large-sized objects or books cannot be received in the fixed sized office cabinets or bookcases.

Thus, conventional office cabinets or bookcases with changeable sized receiving spaces have been developed. A user can change the sizes of the receiving spaces by manually detaching the spacers and positioning posts which support the spacers. The user changes fixing positions of the positioning posts to change the position of the spacer and the size of the receiving spaces. However, it is difficult to detach the positioning posts from the inner walls of the office cabinet or the bookcase, which causes inconvenience to users.

BRIEF SUMMARY OF THE INVENTION

A detailed description is given in the following embodiments with reference to the accompanying drawings.

A receiving method is provided comprising the following steps. First, a receiving device is provided, wherein the receiving device comprises a chamber, a plurality of spacers, a spacer moving module, a first cover unit, a second cover unit, a control unit and an input interface. Then, an order is inputted to the input surface, wherein the input surface sends a control signal according to the order, and the control unit controls movements of the first cover unit, the second cover unit and the spacer moving module according to the control signal.

Utilizing the receiving device of the invention, sizes of the receiving spaces are automatically changed according to sizes of the contents. Therefore, space of the chamber is sufficiently used.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
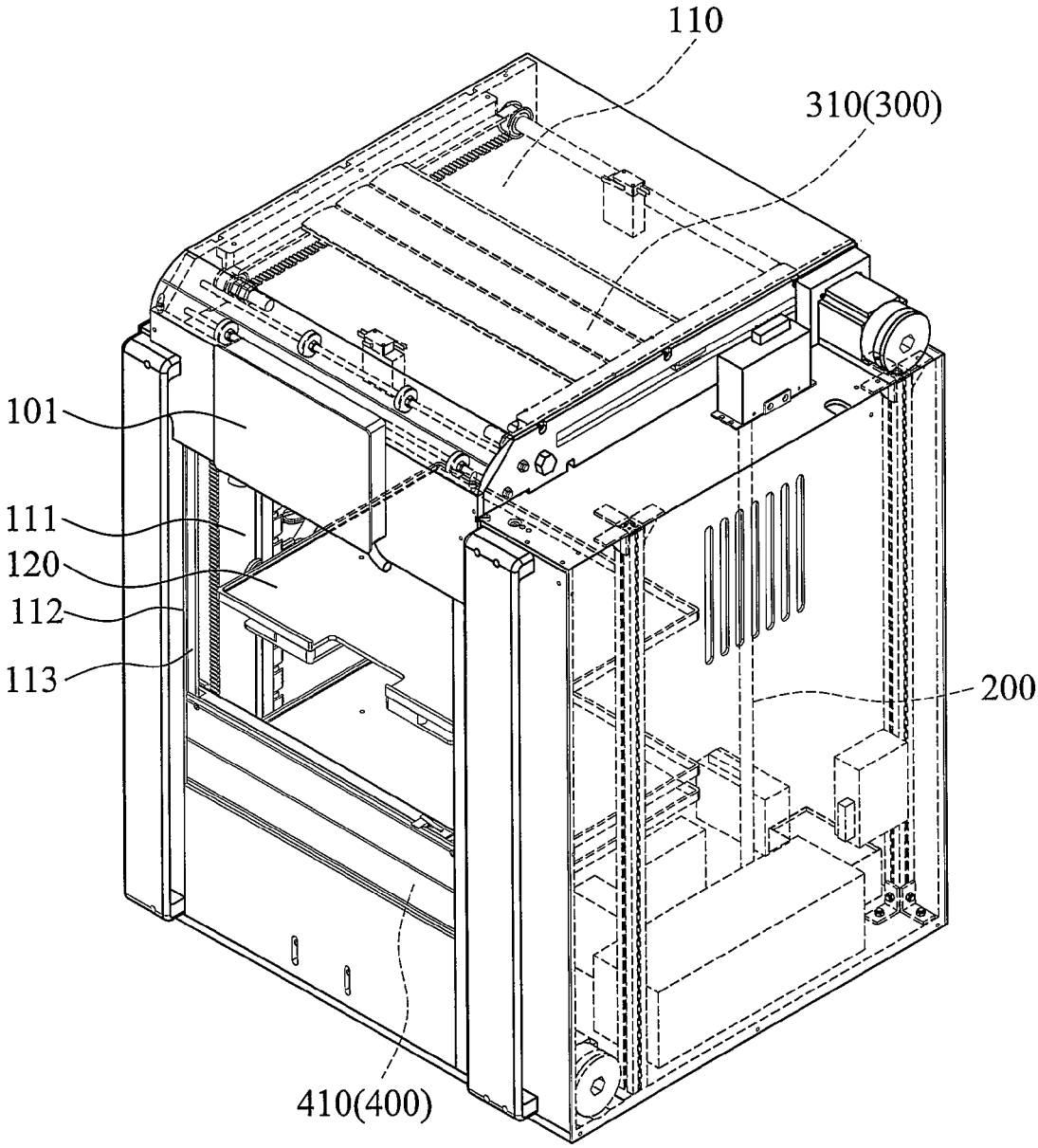
FIG. 1 shows a receiving device of the invention.

FIG. 1 shows a receiving device 100 of the invention, comprising a chamber 110, a plurality of positioners (not shown), a spacer moving module 200, a first cover unit 300 and a second cover unit 400.

The chamber 110 comprises an opening 112, a plurality of receiving spaces 111 and guiding grooves 113. The receiving spaces 111 are defined by the spacers 120. The positioners are disposed in the chamber 110. The spacers 120 are detachably connected to the positioners. The spacer moving module 200 moves the spacers 120 relative to the positioners to change sizes of the receiving spaces 111.

The first cover unit 300 comprises a first cover element 310. The second cover unit 400 comprises a second cover element 410. The first cover element 310 and the second cover element 410 slide in the guiding grooves 113. The opening 112 is closed when the first cover element 310 and the second cover element 410 contacts each other, and the opening 112 is opened when the first cover element 310 and the second cover element 410 is separated from each other.

Figure 2:
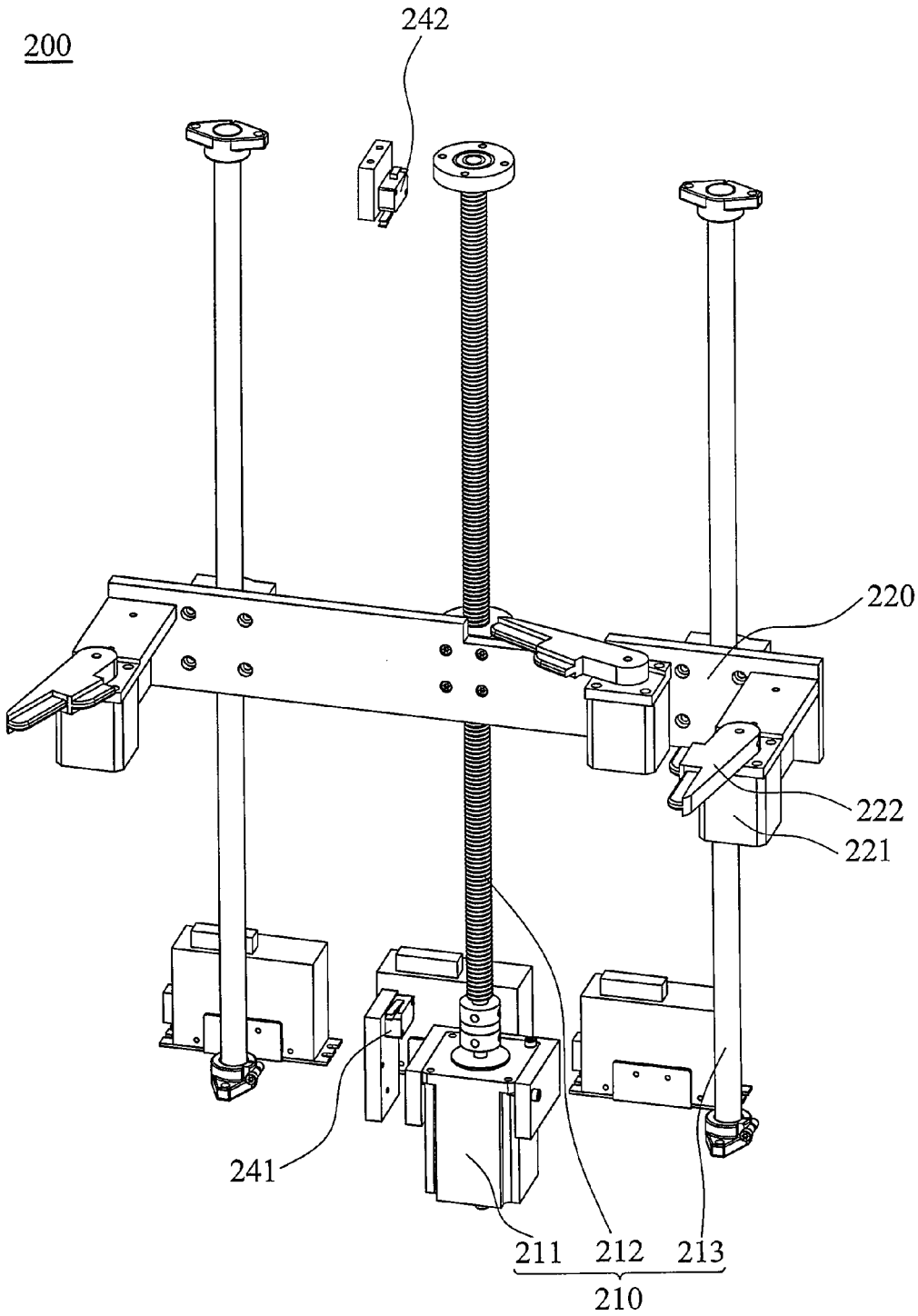
FIG. 2 shows a detailed structure of a spacer moving module of the invention.

FIG. 2 shows a detailed structure of the spacer moving module 200. The spacer moving module 200 comprises a moving unit 210 and a holding unit 220. The holding unit 220 holds the spacers. The moving unit 210 moves the holding unit 220. The moving unit 210 comprises an actuating element 211, a rod 212 and rods 213. The actuating element 211 is a motor, and the rod 212 is a thread rod. The actuating element 211 is connected to and rotates the rod 212 to move the holding unit 220 on the rod 212. The holding unit 220 is connected to the rods 213, which are smooth rods to limit a moving path of the holding unit 220. In the embodiment of the invention, the actuating element 211 is a stepping motor, which precisely controls position of the holding unit 220.

The holding unit 220 comprises a plurality of actuators 221 and a plurality of holding elements 222. The actuators 221 actuate the holding elements 220 to hold the spacers. The actuators 221 are motors.

Figure 3:
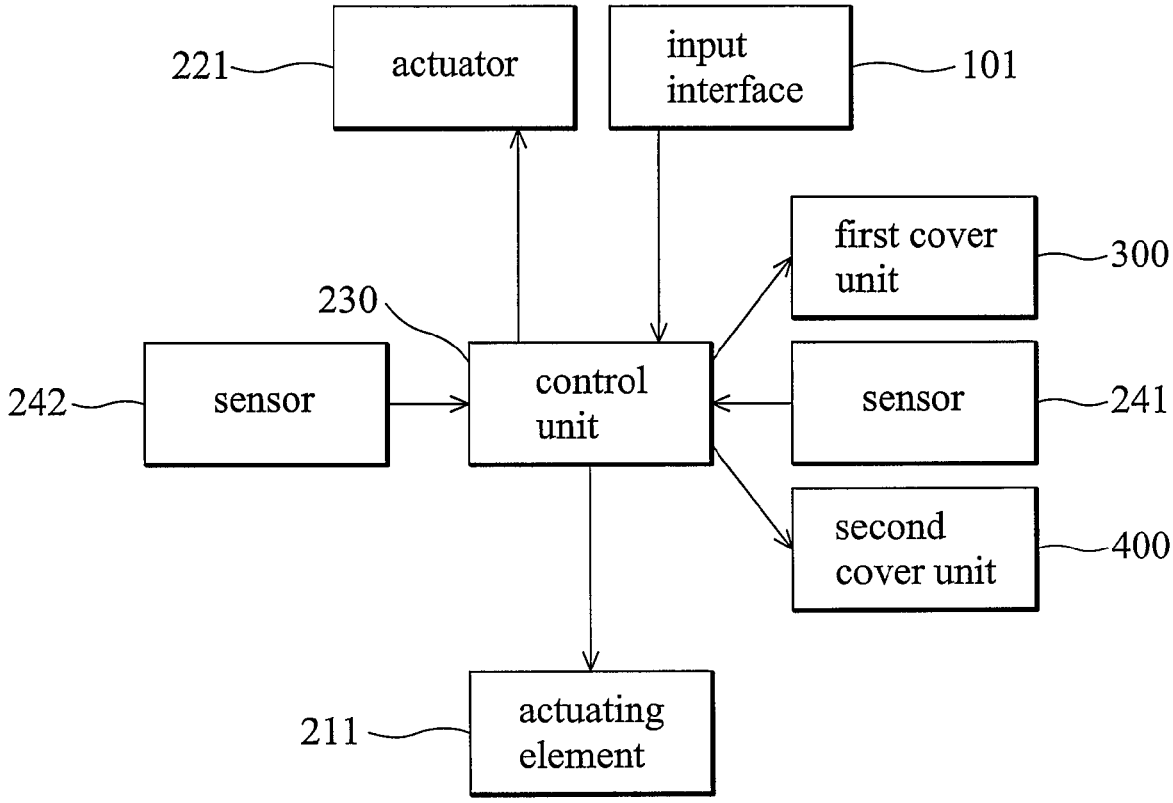
FIG. 3 is a block diagram of the receiving device of the invention.

With reference to FIG. 3, the spacer moving module 200 further comprises a control unit 230. The control unit 230 is electrically connected to the input interface 101, the actuating element 211 and the actuators 221. The control unit 230 controls the actuating element 211 and the actuators 221 according to orders inputted to the input interface 101. With reference to FIG. 2, the spacer moving module 200 further comprises a sensor 241 and a sensor 242. The sensor 241 and the sensor 242 are disposed in the chamber, and electrically connected to the control unit 230. The sensor 241 and the sensor 242 detect a position of the holding unit 220 to prevent the holding unit 220 from extraordinary collision. In the embodiment of the invention, the sensor 241 and the sensor 242 are limit switches.

Figure 4:
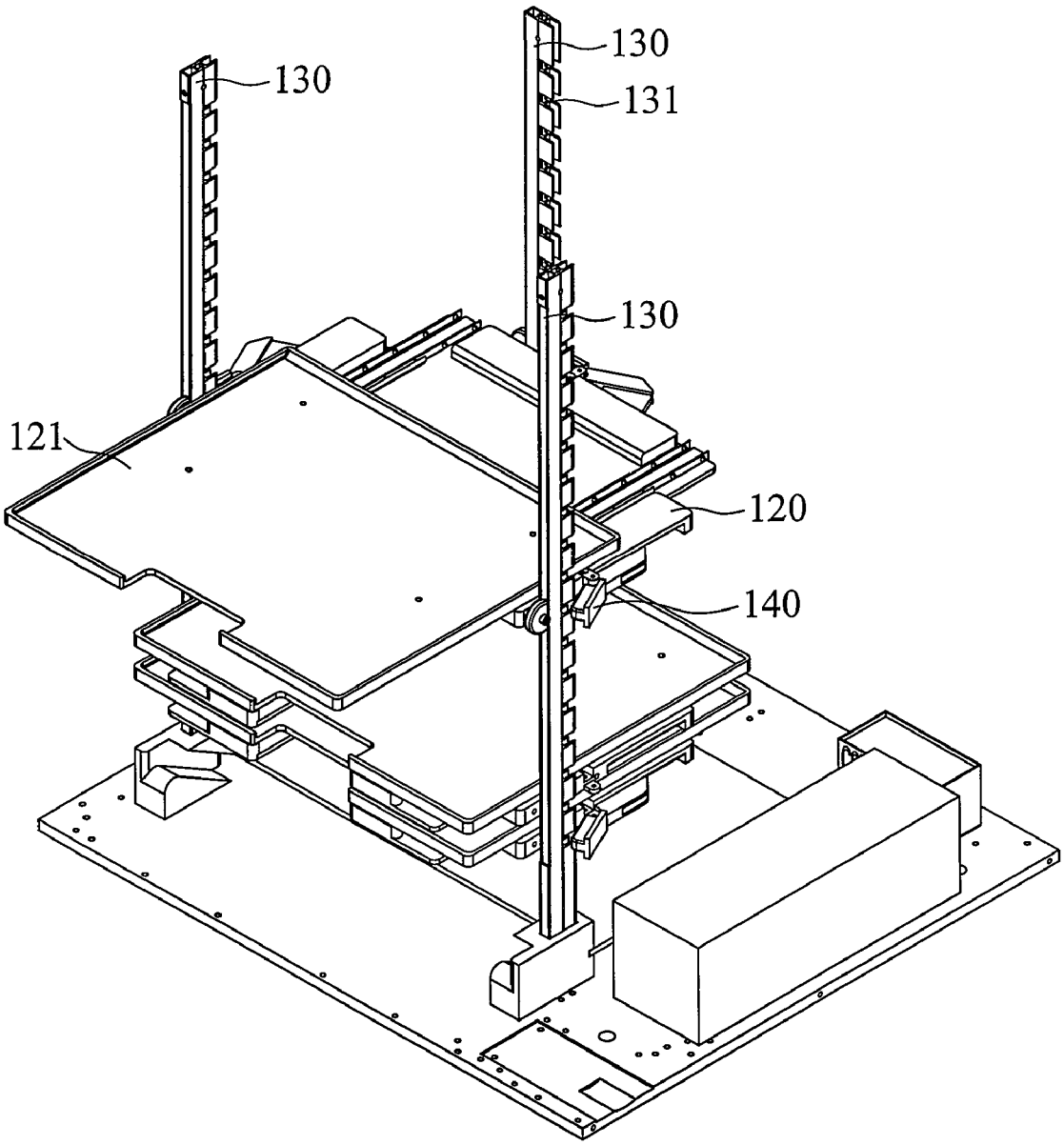
FIG. 4 shows a detailed structure of spacers and positioners of the invention.

FIG. 4 shows a detailed structure of the spacers 120 and the positioners 130. Each spacer 120 comprises a plurality of wedging unit 140. The wedging units 140 are disposed on edges of the spacer 120. The spacer 120 is detachably disposed on the positioners 130 via the wedging units 140. The spacer 120 further comprises an extending plate 121. The extending plate 121 slides on the surface of the spacer 120. Each positioner 130 comprises a plurality of positioning notches 131. The positioning notches 131 are wedged to the wedging unit 140 to fix the spacer 120.

Figure 5A:
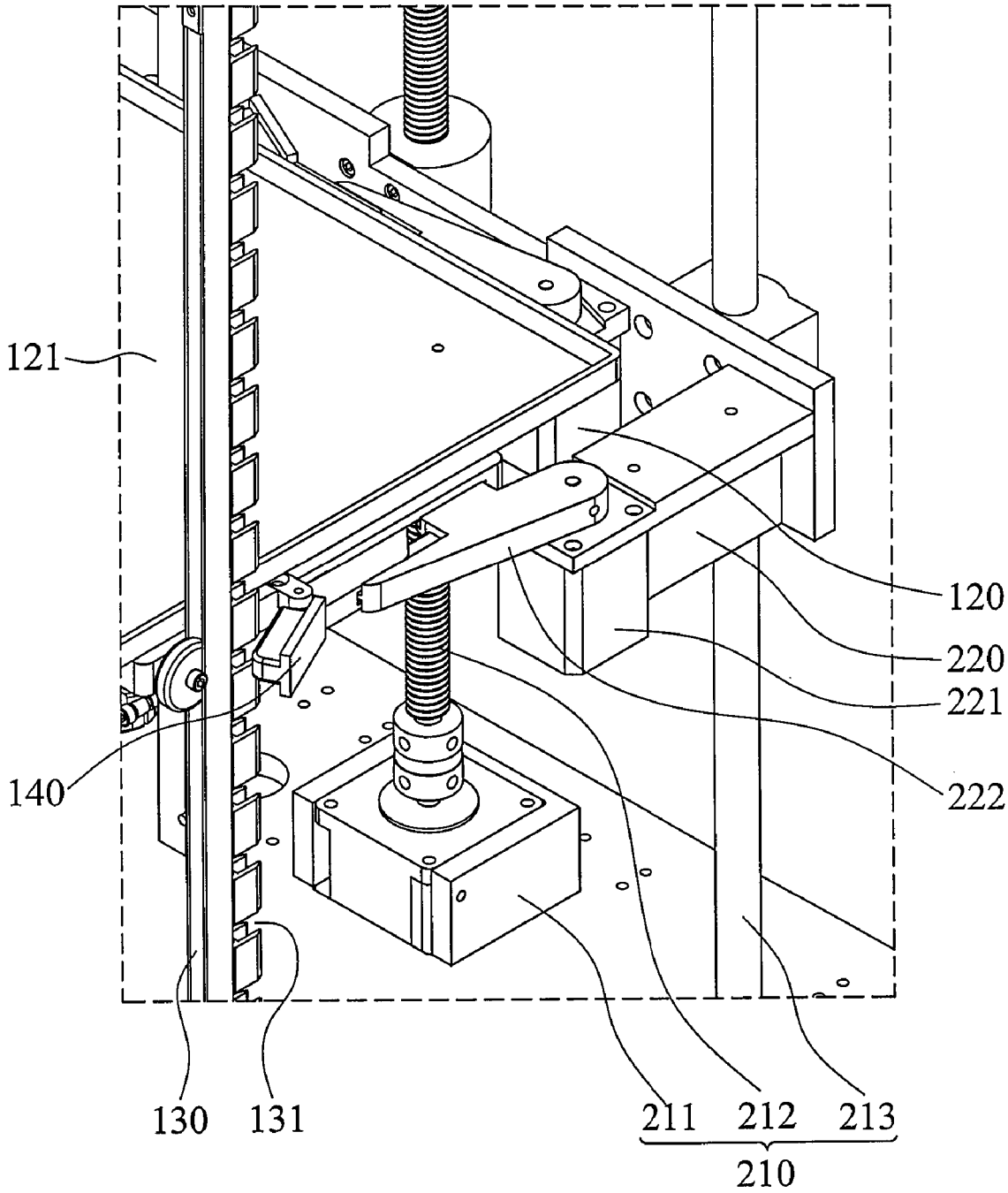
FIGS. 5*a* and 5*b* show wedging units separated from the positioners.
Figure 5B:
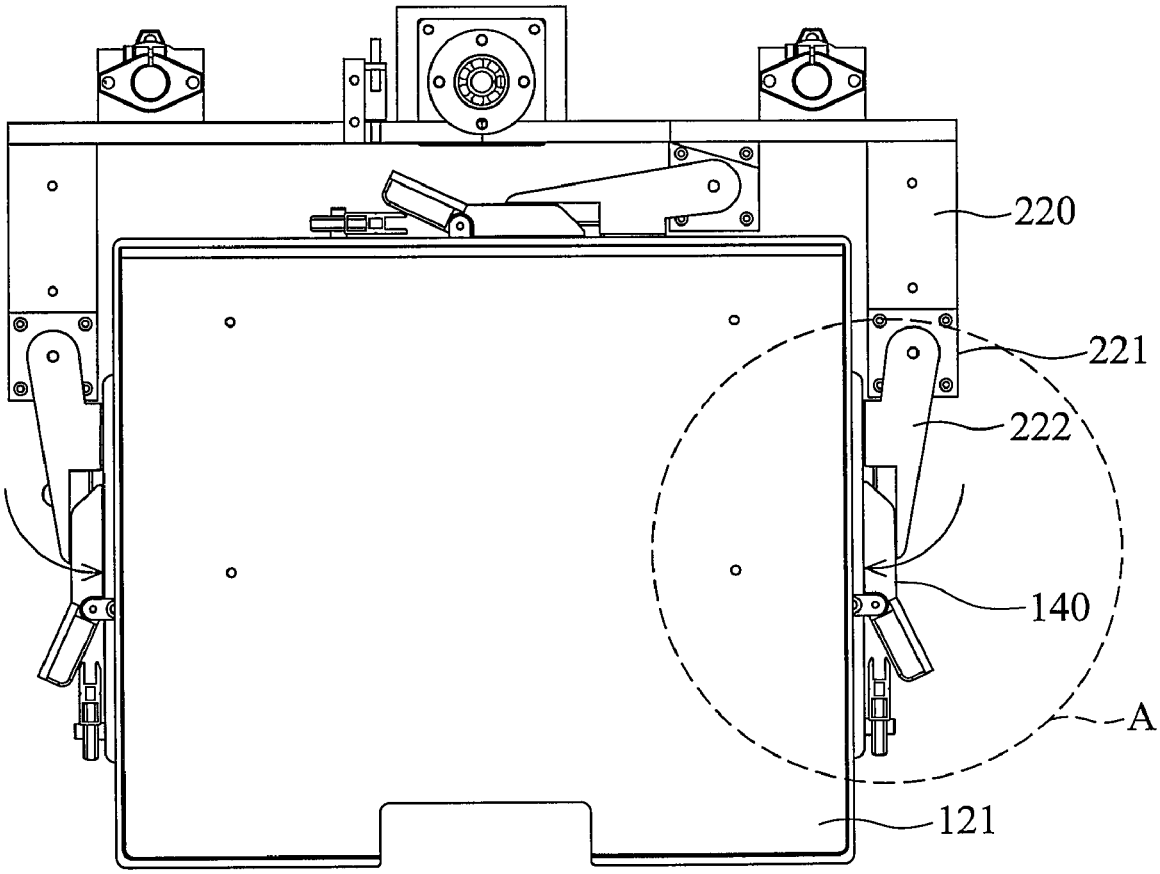
Figure 5C:
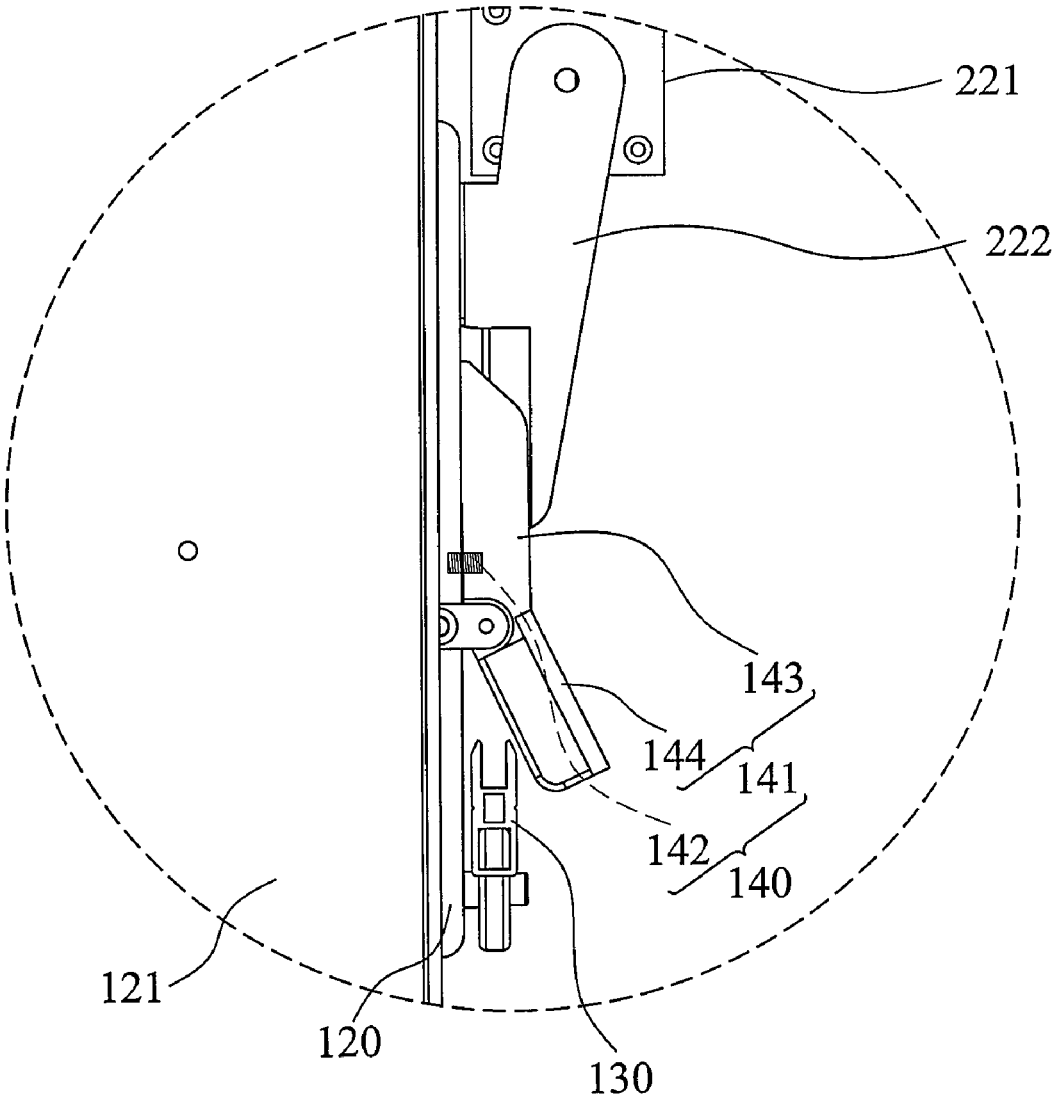
FIG. 5*c* is an enlarged view of the portion A of FIG. 5*b;*

FIGS. 5*a* and 5*b* show the wedging units 140 separated from the positioners 130. FIG. 5*c* is an enlarged view of portion A of FIG. 5*b*, wherein the holding elements 222 press the wedging unit 140. Each wedging unit 140 comprises a lever 141 and an elastic element 142. The lever 141 comprises a wedging portion 144 and a holding portion 143. The holding element 222 presses the holding portion 143 to rotate the lever 141 to a first orientation and separate the wedging portion 144 from the positioner 130 to free the spacer 120.

Figure 6A:
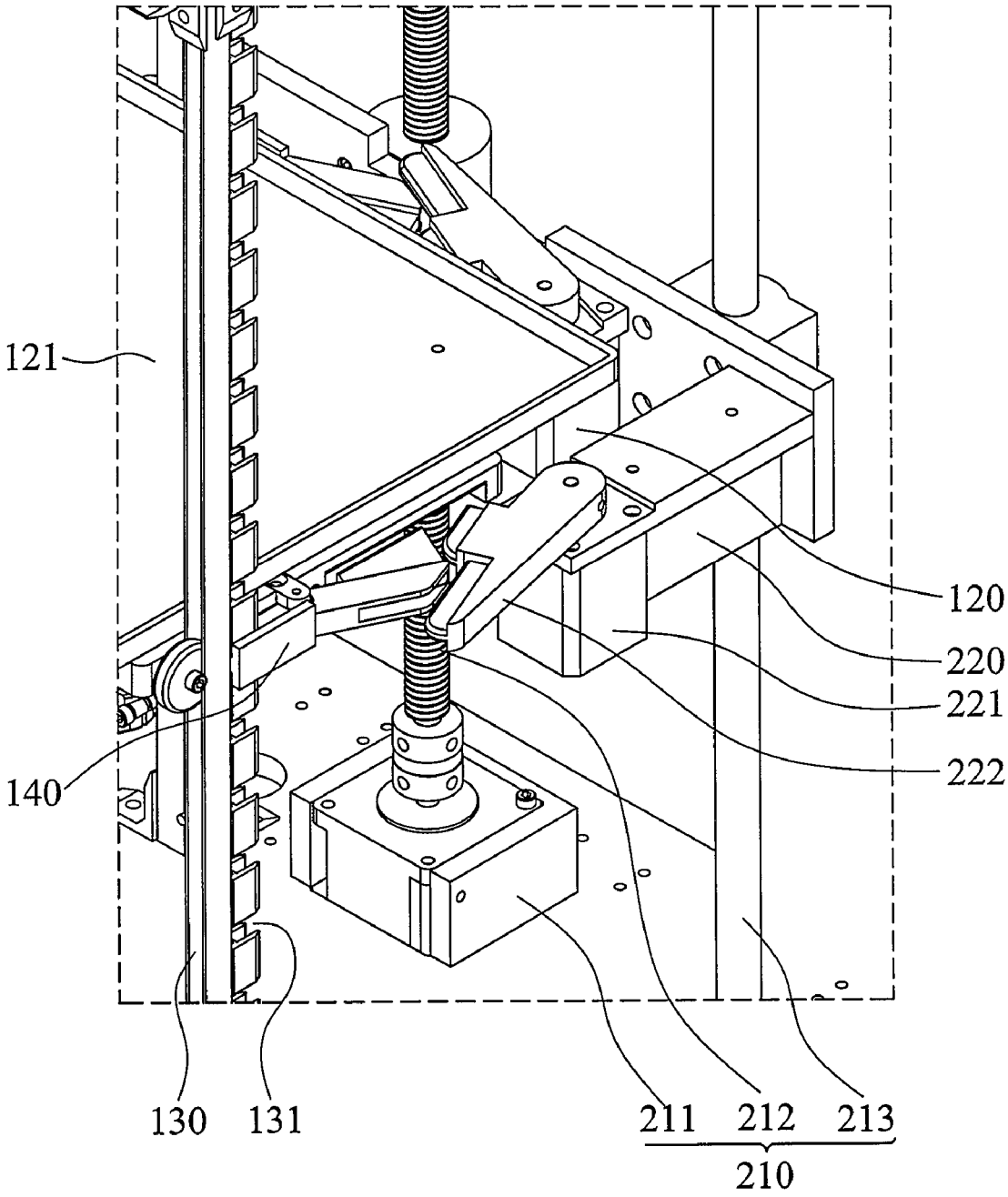
FIGS. 6*a* and 6*b* show the wedging units connected to the positioners.
Figure 6B:
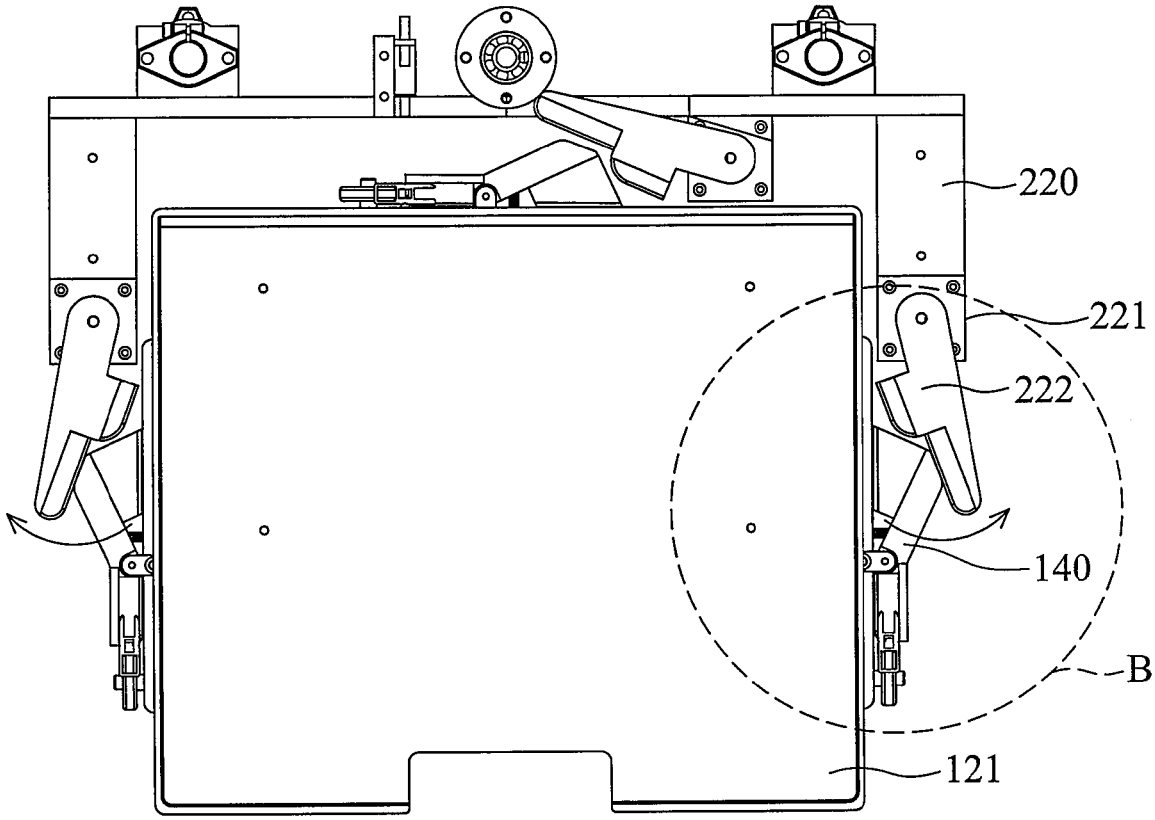
Figure 6C:
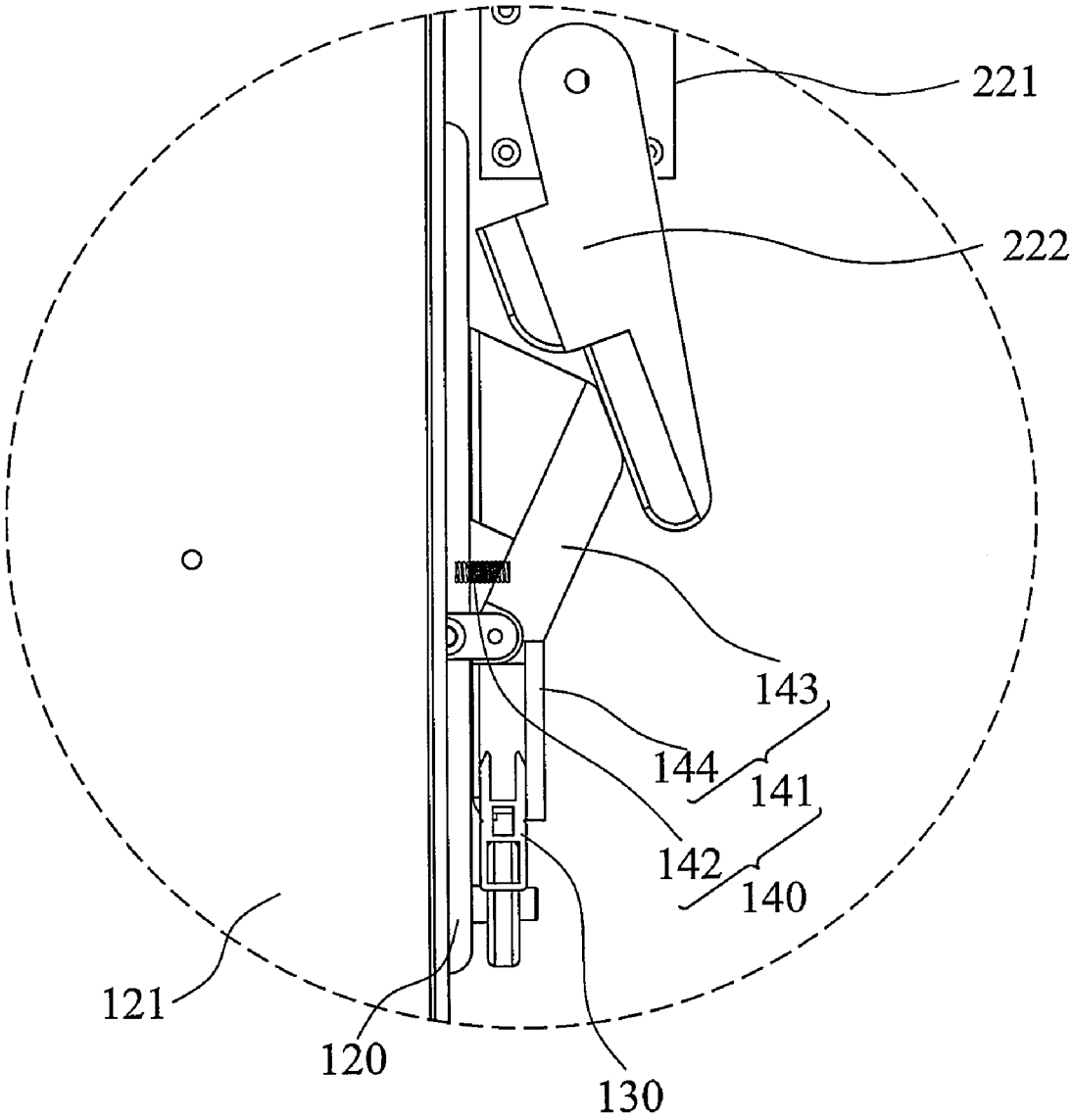
FIG. 6*c* is an enlarged view of the portion B of FIG. 6*b;*

FIGS. 6*a* and 6*b* show the wedging units 140 connected to the positioners 130. FIG. 6*c* is an enlarged view of the portion B of FIG. 6*b*, wherein the holding element 222 is separated from the holding portion 143. The elastic element 142 presses the holding portion 143 to rotate the lever 141 to a second orientation. In the second orientation, the wedging portion 144 enters the positioning notch of the positioner 130 to be fixed thereon.

In the embodiment of the invention, the elastic elements 142 are springs. The spacers 120 are detachably connected to the positioners by rotating the levers 140 between the first and second orientations.

Figure 7:
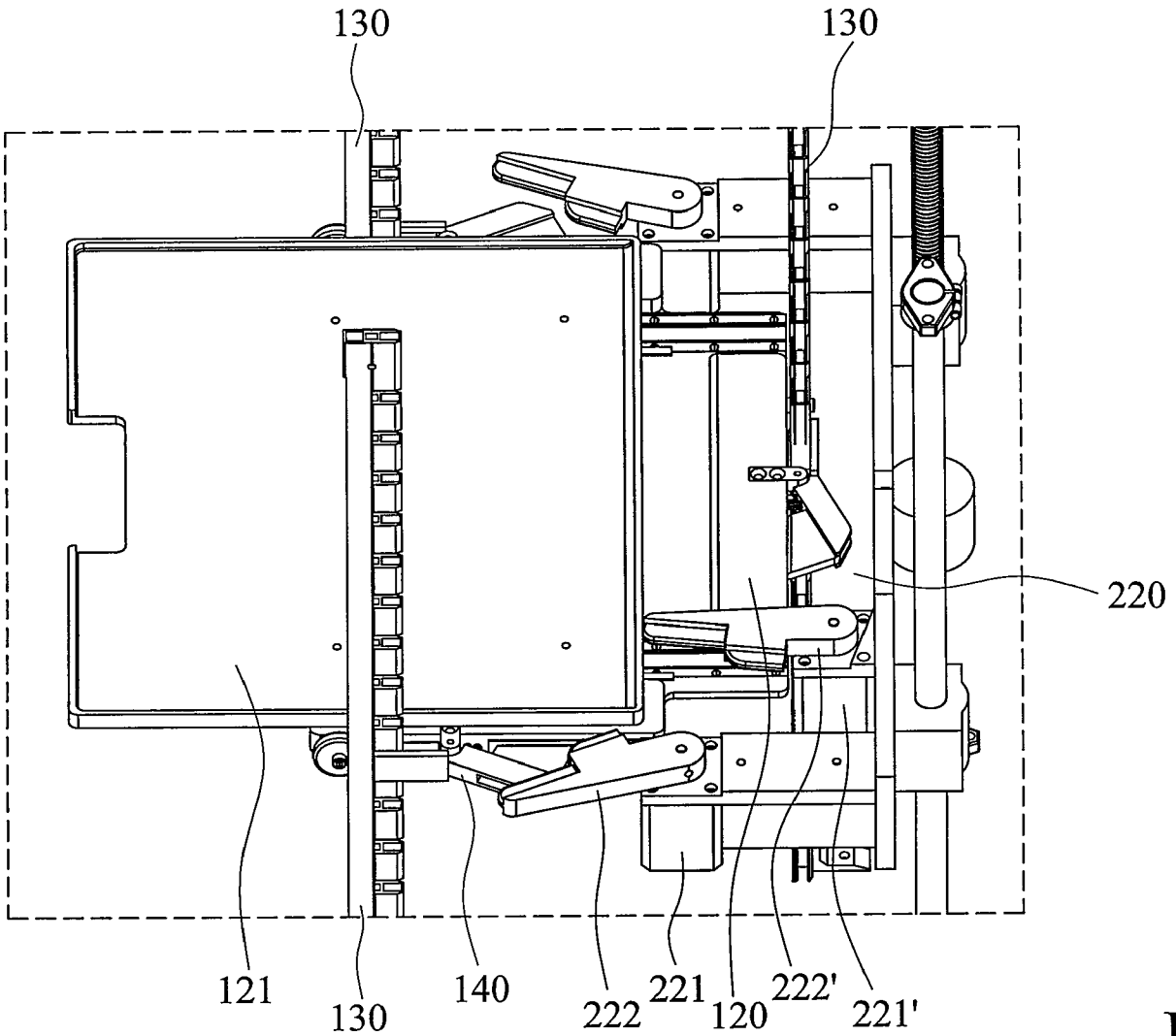
FIG. 7 shows a holding element pushing an extending plate.

Wit reference to FIG. 7, the extending plate slides on the surface of the spacer 120. When a user accesses an object placed on the extending plate, the control unit moves the holding unit 220 corresponding to the extending plate 121. Then, the actuator 221' behind the extending plate 121 actuates the holding element 222' to push the extending plate 121 forward out of the opening of the chamber allowing the user to access the object placed thereon. After accessing the object, the user pushes the extending plate 121 back into the chamber.

In the invention, the spacers are automatically moved to change the sizes of the receiving spaces. The detaching inconvenience of conventional positioning posts is prevented. Additionally, in the invention, the control unit changes the sizes of the receiving spaces according to available space in the receiving device via data inputted by the user. Therefore, the invention saves time, and improves convenience.

With reference to FIG. 3, the control unit 230 is electrically connected to the first cover unit 300 and the second cover unit 400. The control unit 230 controls the first cover element 310 and the second cover element 410 to open the opening 112 at a specific receiving space according to a control signal received from the input interface.

Figure 8:
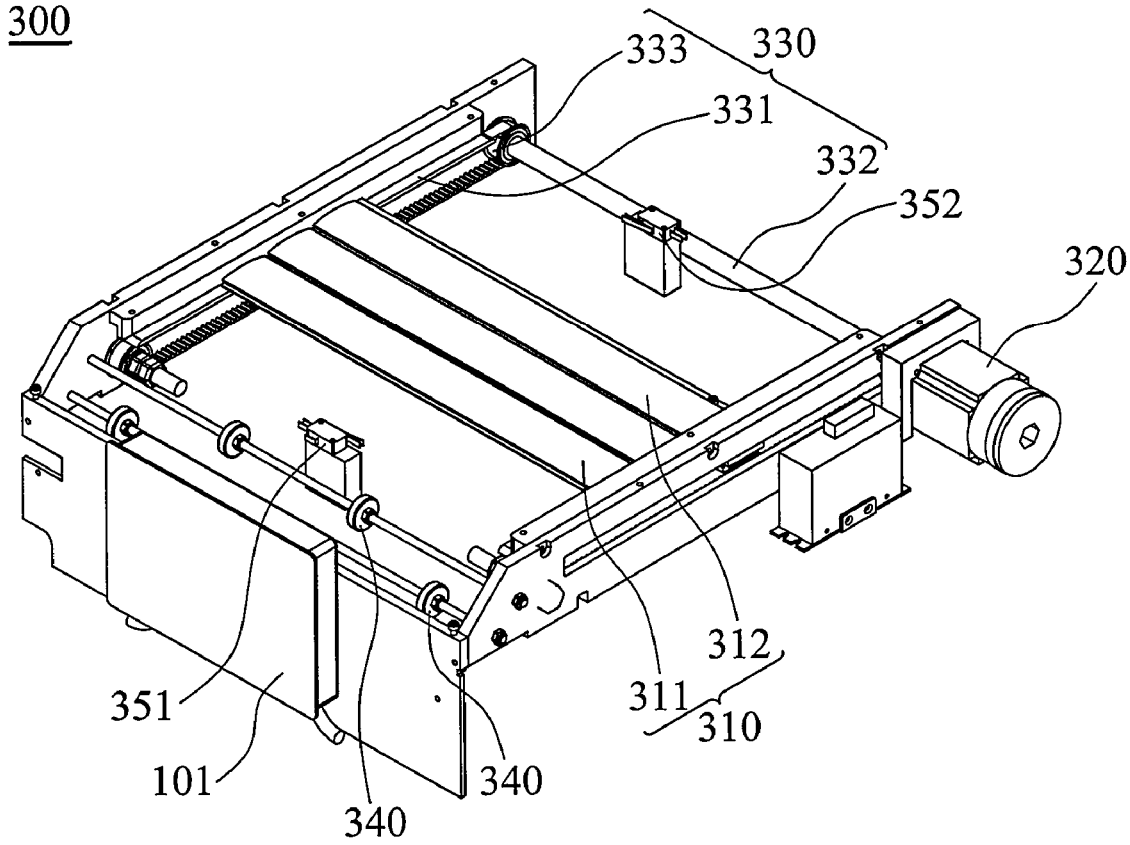
FIG. 8 shows detailed structure of a first cover unit of the invention.

FIG. 8 shows detailed structure of the first cover unit 300. The first cover unit 300 comprises the first cover element 310, a first actuating element 320 and a first transmission unit 330. The first actuating element 320 is connected to the first transmission unit 330. The first transmission unit 330 is connected to the first cover element 310. The first actuating element 320 actuates the first transmission unit 330 to move the first cover element 310.

The first cover element 310 is a rolling door, comprising a plurality of cover blades 311 and a fixing blade 312. The cover blades 311 are connected to each other. The fixing blade 312 is connected to the cover blades 311. The first actuating element 320 is a motor, for example, a stepping motor. The first transmission unit 330 comprises belts 331, a shaft coupling 332 and pulleys 333. The first actuating element 320 is connected to the shaft coupling 332. The shaft coupling 332 is connected to the pulleys 333. The pulleys 333 are connected to the belts 331. The belts 331 are connected to the rolling door 310. The fixing blade 312 is fixed on the belts 331. When the belts 331 move the first cover element 310 forward, the cover blades 311 are separated from the belts 331 one by one to hang down and cover the opening.

In FIG. 8, some cover blades 311 are omitted for brevity and simplification.

The first cover element 300 further comprises a plurality of first guiding wheels 340. The first guiding wheels 340 contact the cover blades 311 to limit a moving path thereof.

The first cover unit 300 further comprises a first front sensor 351 and a first rear sensor 352. The first front sensor 351 and the first rear sensor 352 are electrically connected to the control unit. The first cover element 310 moves between a first front position and a first rear position. The first cover element 310 activates the first front sensor 351 to send a first front signal to the control unit when the first cover element 310 is in the first front position. The first cover element 310 activates the first rear sensor 352 to send a first rear signal to the control unit when the first cover element 310 is in the first rear position. In the embodiment, the first front sensor 351 and the first rear sensor 352 are activated by the fixing blade 312. The first front sensor 351 and the first rear sensor prevent the first cover element 310 from abnormal movement or collision. When the control unit receives the first front or rear signal, the control unit stops the first cover element 310.

Figure 9A:
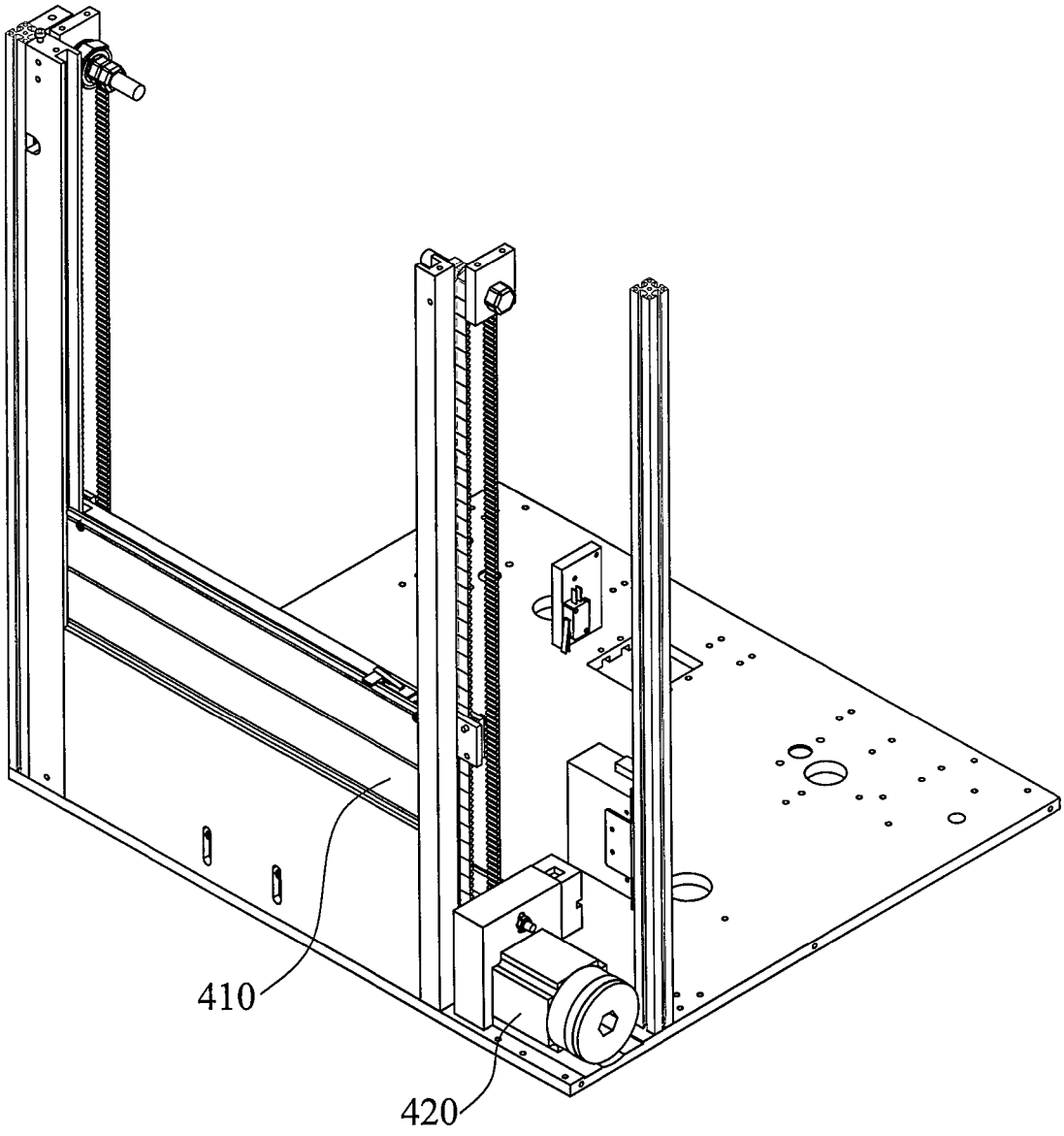
FIGS. 9*a* and 9*b* show detailed structure of a second cover unit of the invention.
Figure 9B:
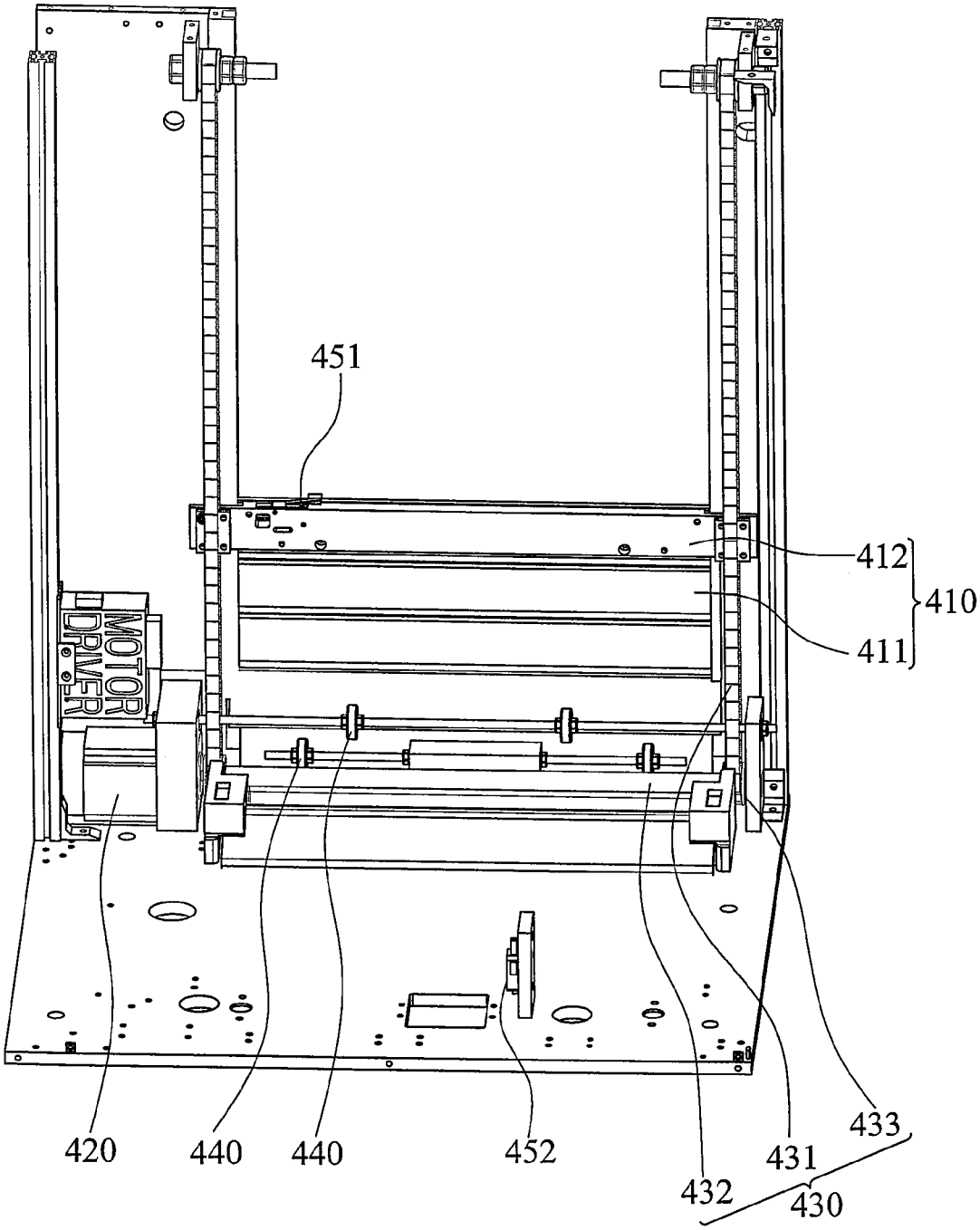

FIGS. 9*a* and 9*b* show detailed structure of the second cover unit 400. The second cover unit 400 comprises the second cover element 410, a second actuating element 420 and a second transmission unit 430. The second actuating element 420 is connected to the second transmission unit 430. The second transmission unit 430 is connected to the second cover element 410. The second actuating element 420 actuates the second transmission unit 430 to move the second cover element 410.

The second cover element 410 is a rolling door, comprising a plurality of cover blades 411 and a fixing blade 412. The cover blades 411 are connected to each other. The fixing blade 412 is connected to the cover blades 411. The second actuating element 420 is a motor, for example, stepping motor. The second transmission unit 430 comprises belts 431, a shaft coupling 432 and pulleys 433. The second actuating element 420 is connected to the shaft coupling 432. The shaft coupling 432 is connected to the pulleys 433. The pulleys 433 are connected to the belts 431. The belts 431 are connected to the rolling door 410. The fixing blade 412 is fixed on the belts 431. When the belts 431 move the second cover element 410 upward, the cover blades 411 are hung up one by one and cover the opening.

In FIGS. 9*a* and 9*b*, some cover blades 411 are omitted for brevity and simplification.

The second cover element 400 further comprises a plurality of second guiding wheels 440. The second guiding wheels 440 contact the cover blades 411 to limit a moving path thereof.

The second cover unit 400 further comprises a second front sensor 451 and a second rear sensor 452. The second front sensor 451 and the second rear sensor 452 are electrically connected to the control unit. The second cover element 410 moves between a second front position and a second rear position. The second cover element 410 activates the second front sensor 451 to send a second front signal to the control unit when the second cover element 410 is in the second front position. The second cover element 410 activates the second rear sensor 452 to send a second rear signal to the control unit when the second cover element 410 is in the second rear position. In the embodiment, the second front sensor 451 is activated when the second cover element 410 contacts the first cover element 310. The second rear sensor 452 is activated by the cover blade 411. The second front sensor 451 and the second rear sensor prevent the second cover element 410 from abnormal movement or collision. When the control unit receives the second front or rear signal, the control unit stops the second cover element 410.

Figure 10A:
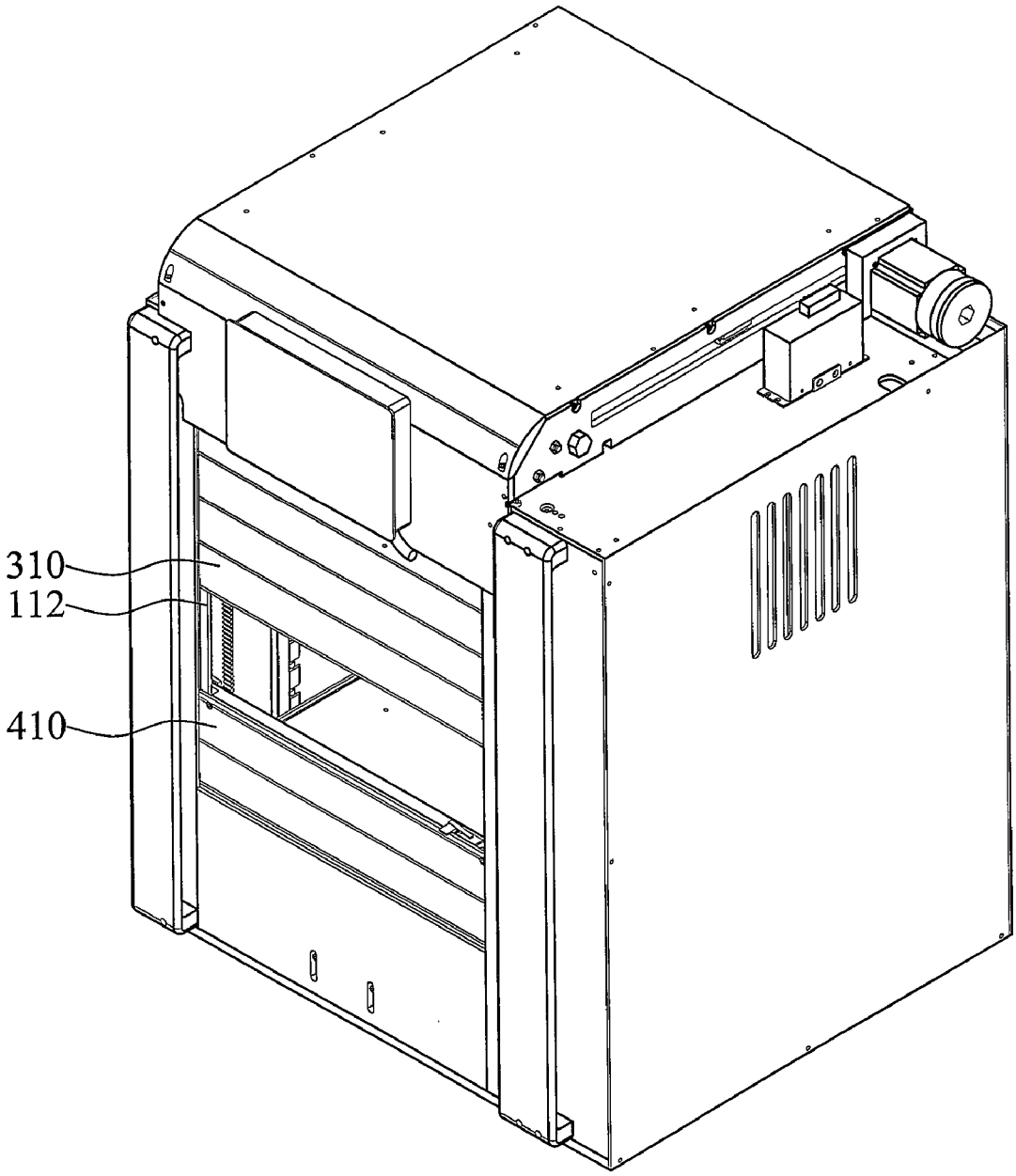
FIGS. 10*a* and 10*b* show the receiving device of the invention opening an opening at a specific receiving space.
Figure 10B:
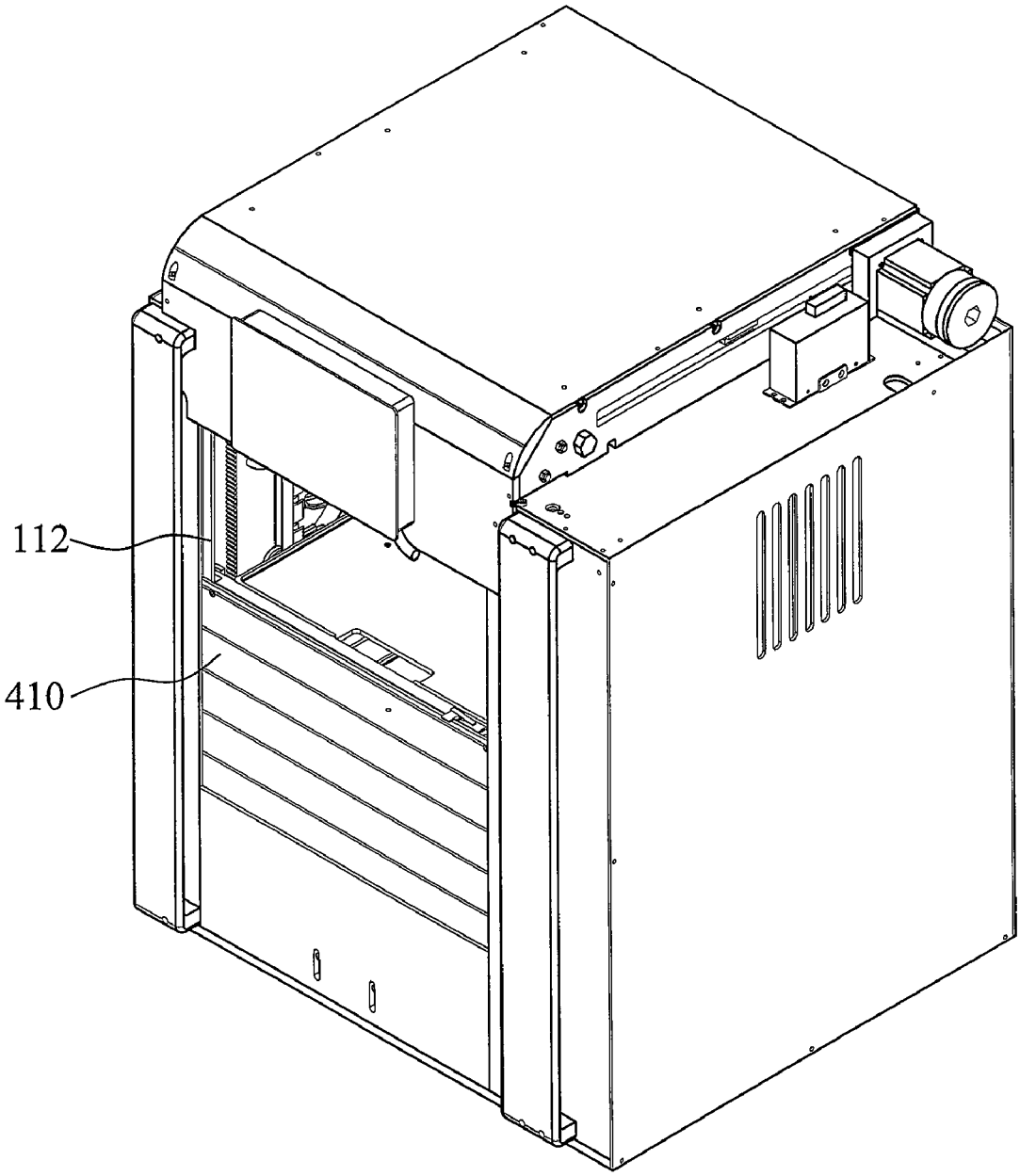

With reference to FIGS. 10*a* and 10*b*, the receiving device 100 of the invention opens the opening 112 at specific receiving space by control positions of the first cover element 310 and the second cover element 410. When the opening 112 is opened, users can only access a specific receiving space. Therefore, when a plurality of people share the receiving device, users can only access allocated receiving space, thus improving confidentiality.

In the embodiment above, motor brakes can be disposed on the first actuating element 320 and the second actuating element 420 to prevent user from forcing the first cover element 310 to separate from the second cover element 410.

A control method of the receiving device of the invention is disclosed hereafter. The spacer moving module moves the spacers according to the control signal to change sizes of the receiving spaces. To simplify the description, the spacers are defined as a first spacer, a second spacer and a third spacer. The second spacer is above the first spacer. A first receiving space is formed between the first and second spacers. The third spacer is above the second spacer. A second receiving space is formed between the second and third spacers. A third receiving space is formed above the third spacer.

A content put-in method is disclosed hereafter.

Figure 11A:
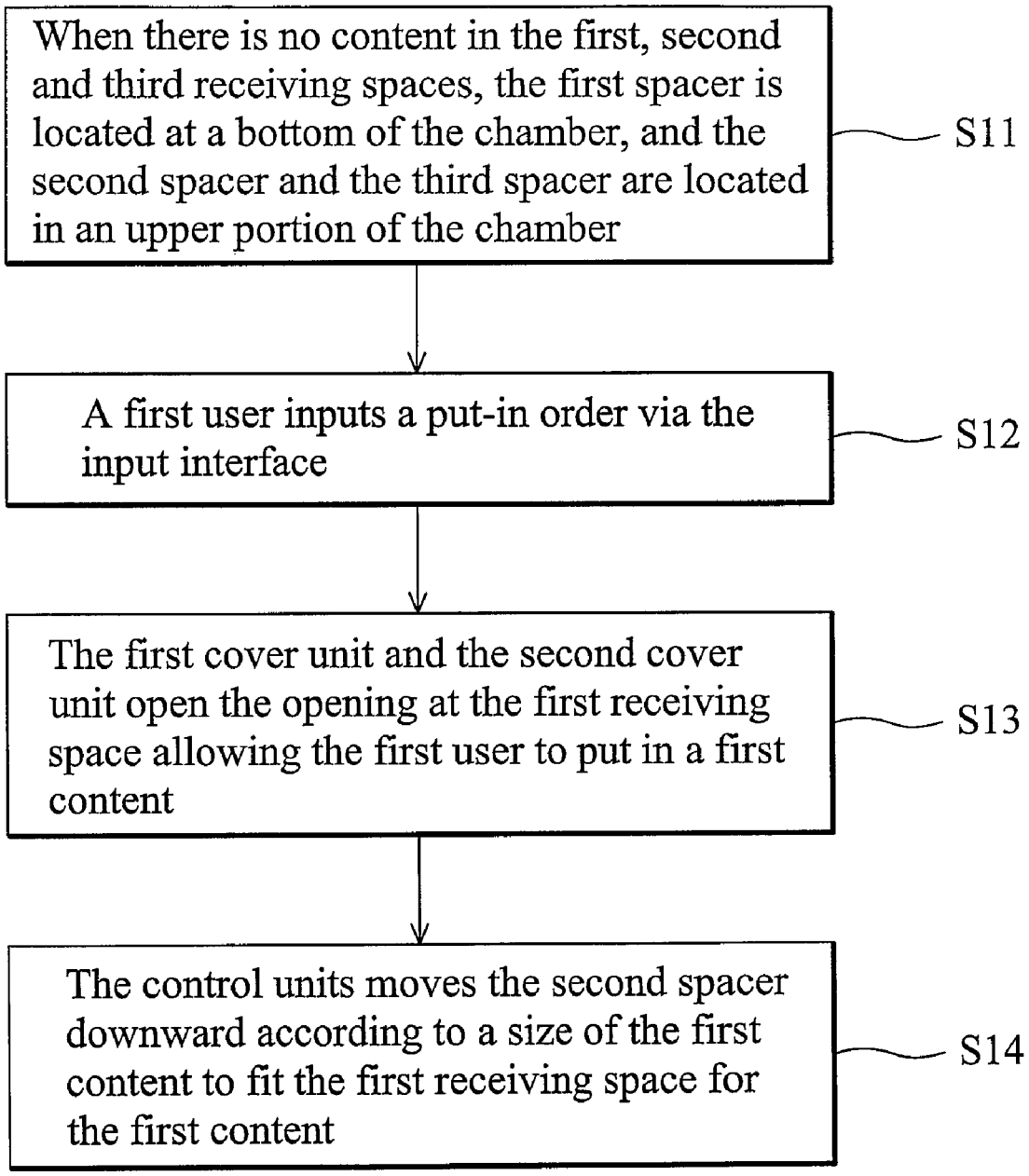
FIG. 11*a* shows a content put-in method of the invention.
Figure 11B:
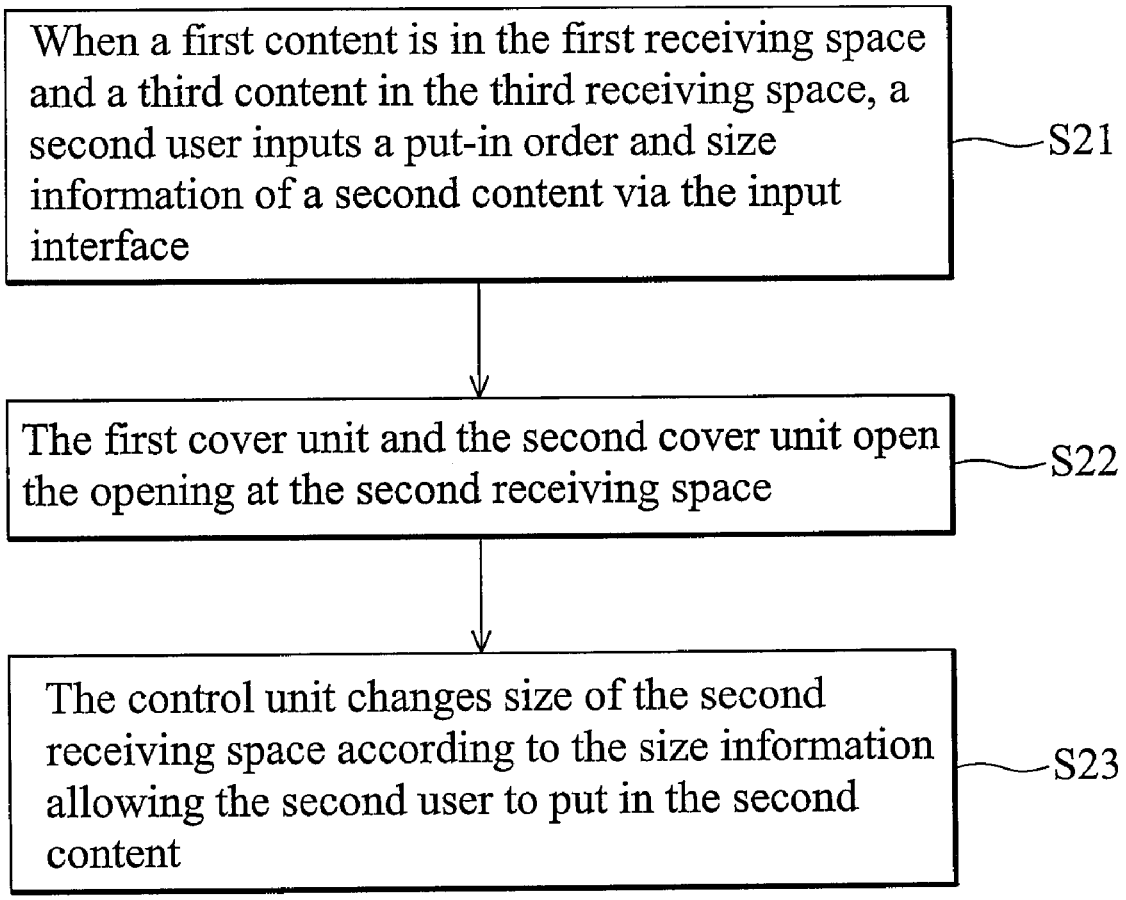
FIG. 11*b* shows another content put-in method of the invention.

With reference to FIG. 11*a*, when there is no content is in the first, second and third receiving spaces, the first spacer is located at a bottom of the chamber, and the second spacer and the third spacer are located at an upper portion of the chamber (S11). After a first user inputs a put-in order via the input interface (S12), the first cover unit and the second cover unit opens the opening at the first receiving space to allowing the first user to put in a first content (S13). Therefore, the first content is directly put into the largest-sized first receiving space. After the first user puts in the first content, the control units moves the second spacer downward according to a size of the first content to fit the first receiving space for the first content (S14).

When the first user inputs the put-in order, a first order is input at the same time. The first order comprises a secret code of the first user. When the first user wants to take out the first content, the first user inputs the first order via the input interface, and the control unit controls the first cover unit and the second cover unit to open the opening at the first receiving space. Therefore, confidentiality is improved.

As mentioned above, a second user can access the second receiving space via a second order.

The first and second users are defined by content putting sequence.

When a first content is in the first receiving space and a second content is in the second receiving space, a third user directly puts a third content into the third receiving space with no spacer movement.

Figure 11C:
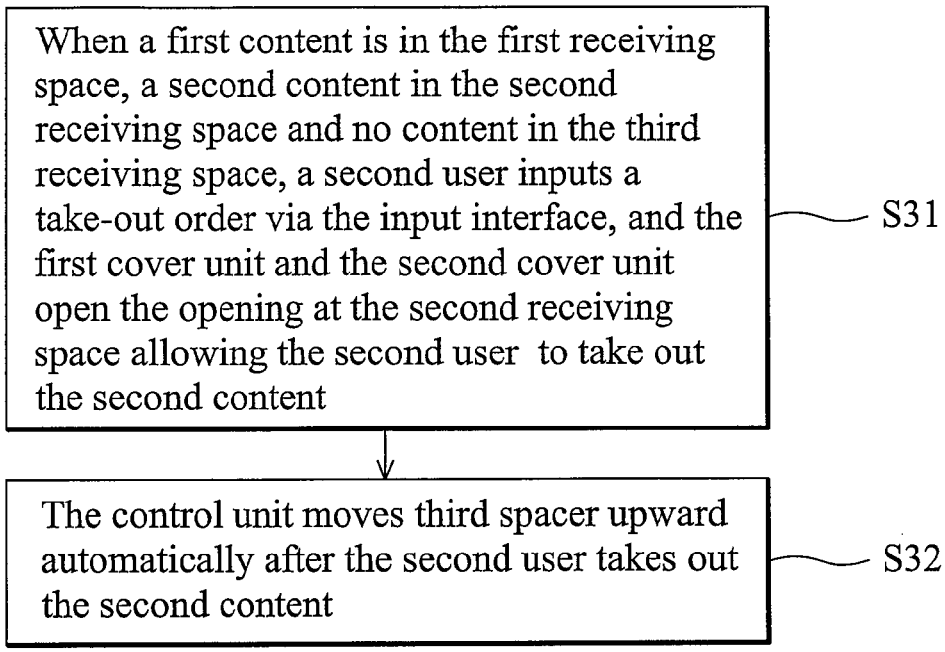
FIG. 11*c* shows a content take-out method of the invention.

With reference to FIG. 11*c*, when a first content is in the first receiving space and a third content is in the third receiving space, a second user inputs a put-in order and size information of a second content via the input interface (S21). Then, the first cover unit and the second cover unit open the opening at the second receiving space (S22). Next, the control unit changes size of the second receiving space according to the size information allowing the second user to put in the second content (S23).

A content take-out method is disclosed hereafter.

When the second and third receiving space are empty and a first content is in the first receiving space, the second spacers are automatically moved upward to an initial position after the first content is taken out of the first receiving space.

With reference to FIG. 11*c*, when a first content is in the first receiving space, a second content is in the second receiving space and no content is in the third receiving space, a second user inputs a take-out order via the input interface, and the first cover unit and the second cover unit opens the opening at the second receiving space to allowing the second user to take out the second content (S31). Then, the control unit automatically moves the third spacer upward after the second user takes out the second content (S32).

Figure 11D:
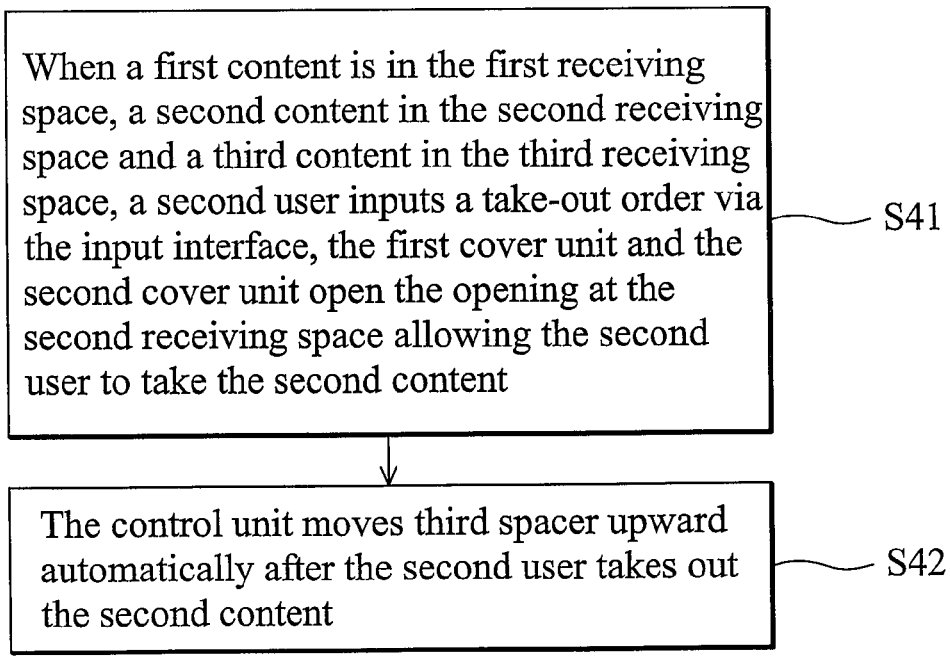
FIG. 11*d* shows another content take-out method of the invention.

With reference to FIG. 11*d*, when a first content is in the first receiving space, a second content is in the second receiving space and a third content is in the third receiving space, a second user inputs a take-out order via the input interface, the first cover unit and the second cover unit opens the opening at the second receiving space to allow the second user to take out the second content (S41). Then, the control unit automatically moves the third spacer upward after the second user takes out the second content (S42) to increase the size of the second receiving space.

In the content put-in and take-out methods above, the extending plate is pushed forward (toward the opening of the chamber) allowing the user to access the content thereon. After the user accesses the content, the user pushes the extending plate back into the chamber.

Utilizing the receiving device of the invention, sizes of the receiving spaces are automatically changed according to sizes of the contents. Therefore, space of the chamber is sufficiently used.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A receiving method, comprising:

providing a receiving device, wherein the receiving device comprises:

a chamber, having an opening;

a plurality of spacers, disposed in the chamber and defining a plurality of receiving spaces;

a spacer moving module, disposed in the chamber, wherein the spacer moving module moves the spacers in the chamber to change sizes of the receiving spaces;

a first cover unit, comprising a first cover element;

a second cover unit, comprising a second cover element, wherein the opening is closed when the first cover element and the second cover element contacts each other, and the opening is opened when the first cover element and the second cover element is separated from each other;

a control unit, electrically connected to the first cover unit, the second cover unit and the spacer moving module; and an input interface, electrically connected to the control unit; and inputting an order to the input surface, wherein the input surface sends a control signal according to the order, and the control unit controls movements of the first cover unit, the second cover unit and the spacer moving module according to the control signal.

2. The receiving method as claimed in claim 1, wherein the spacer moving module moves the spacers according to the control signal to change sizes of the receiving spaces.

3. The receiving method as claimed in claim 2, wherein the spacers comprise a first spacer and a second spacer, the second spacer is above the first spacer, a first receiving space is formed between the first spacer and the second spacer, and a second receiving space is formed above the second spacer.

4. The receiving method as claimed in claim 3, wherein when there is no content is in the first and second receiving spaces, the first spacer is located at a bottom of the chamber, and the second spacer is located at an upper portion of the chamber, and after a first user inputs a put-in order via the input interface, the first cover unit and the second cover unit opens the opening at the first receiving space to allowing the first user to put in a first content.

5. The receiving method as claimed in claim 4, wherein after the first user puts in the first content, the control units moves the second spacer downward according to a size of the first content to fit the first receiving space for the first content.

6. The receiving method as claimed in claim 3, wherein when a first content is in the first receiving space and a second content is in the second receiving space, a second user inputs a take-out order via the input interface, and the first cover unit and the second cover unit opens the opening at the second receiving space to allowing the second user to take out the second content.

7. The receiving method as claimed in claim 6, wherein the spacers further comprise a third spacer located above the second spacer, and the control unit automatically moves the third spacer upward after the second user takes out the second content.

8. The receiving method as claimed in claim 3, wherein the spacers further comprise a third spacer located above the second spacer, the second receiving space is formed between the second spacer and the third spacer, and a third receiving space is formed above the third spacer.

9. The receiving method as claimed in claim 8, wherein when a first content is in the first receiving space and a third content is in the third receiving space, a second user inputs a put-in order via the input interface, and the first cover unit and the second cover unit opens the opening at the second receiving space to allowing the second user to put in a second content.

10. The receiving method as claimed in claim 9, wherein the control unit changes size of the second receiving space according to the put-in order allowing the second user to put in the second content.

11. The receiving method as claimed in claim 8, wherein when a first content is in the first receiving space, a second content is in the second receiving space and a third content is in the third receiving space, a second user inputs a take-out order via the input interface, and the first cover unit and the second cover unit opens the opening at the second receiving space to allowing the second user to take out the second content.

12. The receiving method as claimed in claim 11, wherein the control unit automatically moves the third spacer upward after the second user takes out the second content.

13. The receiving method as claimed in claim 1, wherein the control unit opens the opening at specific position according to an order for allowing users to access content in a specific receiving space.

14. The receiving method as claimed in claim 13, wherein the spacers comprise a first spacer and a second spacer, the second spacer is above the first spacer, a first receiving space is formed between the first spacer and the second spacer, and a second receiving space is formed above the second spacer.

15. The receiving method as claimed in claim 14, wherein when the first user inputs a first order via the input interface, the control unit controls the first cover unit and the second cover unit to open the opening at the first receiving space.

16. The receiving method as claimed in claim 15, wherein when the second user inputs a second order via the input interface, the control unit controls the first cover unit and the second cover unit to open the opening at the second receiving space.

* * * * *